US005886571A

United States Patent [19]

Suwabe

[11] Patent Number: 5,886,571

[45] Date of Patent: Mar. 23, 1999

[54] CONSTANT VOLTAGE REGULATOR

[75] Inventor: Hiroyuki Suwabe, Yokohama, Japan

[73] Assignee: Kabushiki Kaisha Toshiba, Kawasaki, Japan

[21] Appl. No.: 919,286

[22] Filed: Aug. 28, 1997

[30] Foreign Application Priority Data

Aug. 30, 1996 [JP] Japan ..... 8-230148

[51] Int. Cl.[6] ..... G05F 1/10; G05F 3/16

[52] U.S. Cl. ..... 327/541; 327/540; 323/315

[58] Field of Search ..... 327/530, 538, 327/541, 539, 543; 323/315

[56] References Cited

U.S. PATENT DOCUMENTS 4,327,321 4/1982 Suzuki et al. ..... 323/315
5,173,656 12/1992 Seevinck et al. ..... 323/314
5,373,226 12/1994 Kimura ..... 323/313
5,510,750 4/1996 Cho ..... 327/546
5,512,855 4/1996 Kimura ..... 327/538
5,594,382 1/1997 Kato et al. ..... 327/541

*Primary Examiner*—Timothy P. Callahan
*Assistant Examiner*—Hai L. Nguyen
*Attorney, Agent, or Firm*—Oblon, Spivak, McClelland, Maier & Neustadt, P.C.

[57] ABSTRACT

A constant voltage circuit obtains an accurate constant voltage output by reducing the influence of channel length modulation effect of a MOS transistor. A current mirror circuit having two P-channel MOS transistors and two N-channel MOS transistors is added in addition to a main circuit having three P-channel MOS transistors, two N-channel MOS transistors and two resistors. The part of the voltage of the main circuit is input to the current mirror circuit, the output of the current mirror circuit is fed back to the main circuit, and a constant voltage is obtained as the output of the main circuit.

9 Claims, 6 Drawing Sheets

CONSTANT VOLTAGE REGULATOR

BACKGROUND OF THE INVENTION

This invention relates to a constant voltage circuit containing a MOS type integrated circuit and, more particularly, to an improvement to delete the change of an output voltage due to a channel length modulation effect of a MOS transistor.

An example of a conventional constant voltage circuit is shown in FIG. 1. This constant voltage circuit comprises three P-channel MOS transistors P1, P2, P3, two N-channel MOS transistors N1, N2 and two resistors R1, R2.

In the constant voltage circuit of an arrangement as shown in FIG. 1, a current flowing in series through the MOS transistor P1, the resistor R1 and the MOS transistor N1 is I1, a current flowing in series through the MOS transistors P2 and N2 is I2, and a current flowing in series through the MOS transistor P3 and the resistor R2 is I3.

The operation of the constant voltage circuit of FIG. 1 will be simply described. The channel widths of the MOS transistors P1, P2, P3, N1, N2 are respectively WP1, WP2, WP3, WN1, WN2, and the channel lengths of these MOS transistors P1, P2, P3, N1, N2 are respectively LP1, LP2, LP3, LN1, LN2. At this time, the relationship among the LP1, LP2, LP3, LN1, LN2 are set to LP1=LP2=LP3, and LN1=LN2.

The gates of the MOS transistors P1 and P2 are commonly connected, the gate of the MOS transistor P2 is connected to the drain of the same MOS transistor P2, and both the MOS transistors constitute a current mirror circuit. And, the following equation is satisfied in the relationship among the WP2, WP1, I2 and I1:

$$WP2/WP1=I2/I1 \tag{1}$$

Further, the MOS transistors N1, N2 are together operated in a weak inversion region. The gradient of the drain current (logarithm) characteristics to the gate voltage in the weak inversion region is assumed as 1/K. The drain currents of the N-channel MOS transistors when the gate voltage of the N-channel MOS transistor are Vg1. Vg2 are respectively Id1, Id2, the following equation is obtained:

$$1/K=\{1n(Id1)-1n(Id2)\}/(Vg1-Vg2) \tag{2}$$

Accordingly, the following equation is obtained:

$$Id1/Id2=\exp\{(Vg1-Vg2)/K\} \tag{3}$$

That is, when the gate voltages of the N-channel MOS transistors N1, N2 are V11, V12, the following equations are satisfied via I0/L set as a constant.

$$I1=(I0/L)\cdot WN1\cdot\exp\{V11/K\}$$

$$I2=(I0/L)\cdot WN2\cdot\exp\{V12/K\}$$

Accordingly, $$I1/I2=(WN1/WN2)\cdot\exp\{(V11-V12)/K\} \tag{4}$$

Hence, the following equation is obtained:

$$\begin{aligned} WN2/WN1 &= I2/I1\cdot\exp\{(V11-V12)/K\} \\ &= I2/I1\cdot\exp\{(I1\cdot R1)/K\} \end{aligned} \tag{5}$$

Accordingly, from the equations (1) and (5), the following equation is induced.

$$I1\cdot R1=K\cdot 1n\{(WP1/WP2)\cdot(WN2/WN1)\} \tag{6}$$

In the equation (6), the K is determined according to the manufacturing process, and the I1 is set to a desired value by suitably determining the values of the WP1, WP2, WN1, WN2 and R1. At this time, since the equation (6) does not have a parameter depending upon a power source voltage, a constant-current operation is theoretically realized for the power source voltage. Further, since the MOS transistor P3 constitutes a current mirror circuit together with the MOS transistor P2, WP2/WP1=I2/I1, WP3/WP2=I3/I2 are satisfied, and the following equation is obtained:

$$WP3/WP1=I3/I1 \tag{7}$$

Hence, the MOS transistor P3 is operated as a constant-current source for the power source voltage, and an output voltage Vout is given by the following equation:

$$Vout=I3\cdot R2 \tag{8}$$

More specifically, the output voltage Vout does not depend upon the power source voltage VDD but makes it possible to be a constant value.

In the conventional constant voltage circuit, it has been described that the output voltage Vout of the constant value can be always obtained without depending upon the power source voltage VDD. However, this is the case that the channel length modulation effect of the MOS transistor is not considered at all. The channel length modulation effect of the MOS transistor means, as shown in FIG. 2, the phenomenon that, as a voltage VDS between the drain and the source increases, a current IDS between the drain and the source increases. More specifically, in the saturated region of the MOS transistor (Vds≧VGS−VTH) (where the VTH is a threshold voltage), the IDS has a gradient depending upon the VDS according to the channel length modulation effect (In FIG. 2, the VGS show the two characteristics of VGS1 and VGS2).

Accordingly, in the conventional circuit shown in FIG. 1, P-channel and N-channel MOS transistor threshold voltages are VTHP, VTHN. Since the V11, V12 become near the VTHN, the gate voltage V2 of the P-channel MOS transistor P3 becomes near VDD−|VTHP| and the Vout becomes a set predetermined voltage as the power source voltage VDD increases, the VDSs of the MOS transistors P1, P3, N2 increase as the VDD increases. Therefore, channel length modulation effect takes places, and hence the I1, I2, I3 to be originally determined according to the ratio of the WP1, WP2, WP3 cause an error to occur. When the I1 increases due to the channel length modulation effect, the voltages drop of I1.R1 is increased, the gate bias of the MOS transistor N2 is shifted to the GND side, and hence it acts so as to suppress the I2. However, since the increased current due to the channel length modulation effect of the currents I1, I3 predominantly acted, the output voltage Vout given by the previous equation (8) becomes as follows when the current increase of the I3 is ΔI3, $$Vout=(I3+\Delta I3)\cdot R2 \tag{9}$$

the output voltage Vout depends upon the power source voltage in the operating region A of the constant voltage circuit as shown in FIG. 3, and exhibits the characteristics that it becomes larger than the theoretical value. Normally, in the case of the Vout in the order of several volts, when the power source voltage changes at 1V, the output voltage Vout varies about several mV to 100 mV. This decreases the accuracy of the constant voltage output with the result that the reliability of the LSI is impaired.

Heretofore, to eliminate the malfunction, the channel lengths of the respective MOS transistors has been elongated to suppress the changes to the minimum limit. However, this method has a limit, and in this case, the occupying area of the constant voltage circuit on a semiconductor chip is increased.

It is therefore an object of the present invention to provide an accurate constant voltage circuit by reducing the influence of the channel length modulation effect of a MOS transistor.

BRIEF SUMMARY OF THE INVENTION

The foregoing object of the present invention is accomplished by providing a constant voltage circuit comprising first and second power sources; a first polarity first MOS transistor connected at one end of a current path to the first power source; a first polarity second MOS transistor connected at one end of a current path to the first power source and connected at a gate thereof to a gate of the first MOS transistor; a first resistor connected at one end thereof to the other end of the current path of the first MOS transistor; a second polarity third MOS transistor connected at one end of the current path to the other end of the first resistor, connected at the other end of the current path to the second power source and connected at a gate thereof to the one end of the first resistor; a second polarity fourth MOS transistor connected at the one end of the current path to the other end of the current path of the second MOS transistor, connected at the other end of the current path to the second power source and connected at a gate thereof to the other end of the first resistor; a first polarity fifth MOS transistor connected at one end of the current path to the first power source and connected at a gate thereof to the other end of the current path of the second MOS transistor; a first polarity sixth MOS transistor connected at the one end of the current path to the first power source, connected at a gate thereof to a gate common connecting point of the first and second MOS transistors and connected at the gate thereof to the other end of the current path; a current mirror circuit for supplying a current proportional to the current flowing into the current path of the fifth MOS transistor to the sixth MOS transistor; a first polarity seventh MOS transistor connected at the one end of the current path to the first power source, connected at the other end of the current path to a constant voltage output terminal and connected at a gate thereof to the other end of the current path of the second MOS transistor; and a second resistor inserted between the constant voltage output terminal and the second power source.

Further, the present invention provides a constant voltage circuit comprising first and second power sources; a first polarity first MOS transistor connected at one end of a current path to the first power source; a first polarity second MOS transistor connected at one end of a current path to the first power source and connected at a gate thereof to a gate of the first MOS transistor; a first resistor connected at one end thereof to the other end of the current path of the first MOS transistor; a second polarity third MOS transistors connected at one end of the current path to the other end of the first resistor, connected at the other end of the current path to the second power source and connected at a gate thereof to the one end of the first resistor; a second polarity fourth MOS transistor connected at the one end of the current path to the other end of the current path of the second MOS transistor, connected at the other end of the current path to the second power source and connected at a gate thereof to the other end of the first resistor; a first polarity fifth MOS transistor connected at one end of the current path to the first power source and connected at a gate thereof to the other end of the current path of the second MOS transistor; a first polarity sixth MOS transistor connected at the one end of the current path to the first power source, connected at a gate thereof to a gate common connecting point of the first and second MOS transistors and connected at the gate thereof to the other end of the current path; a current mirror circuit for supplying a current proportional to the current flowing into the current path of the fifth MOS transistor to the sixth MOS transistor; a second resistor inserted between the first power source and a constant voltage output terminal; and a first second polarity seventh MOS transistor connected at the one end of the current path to the constant voltage output terminal, connected at the other end of the current path to the second power source and connected at a gate thereof to the other end of the first.

BRIEF DESCRIPTION OF THE SEVERAL VIEWS OF THE DRAWING

The present invention can be more fully understood from the following detailed description when taken in conjunction with the accompanying drawings, in which.

DETAILED DESCRIPTION OF THE INVENTION

The present invention will now be described according to embodiments with reference to the accompanying drawings.

Figure 4:
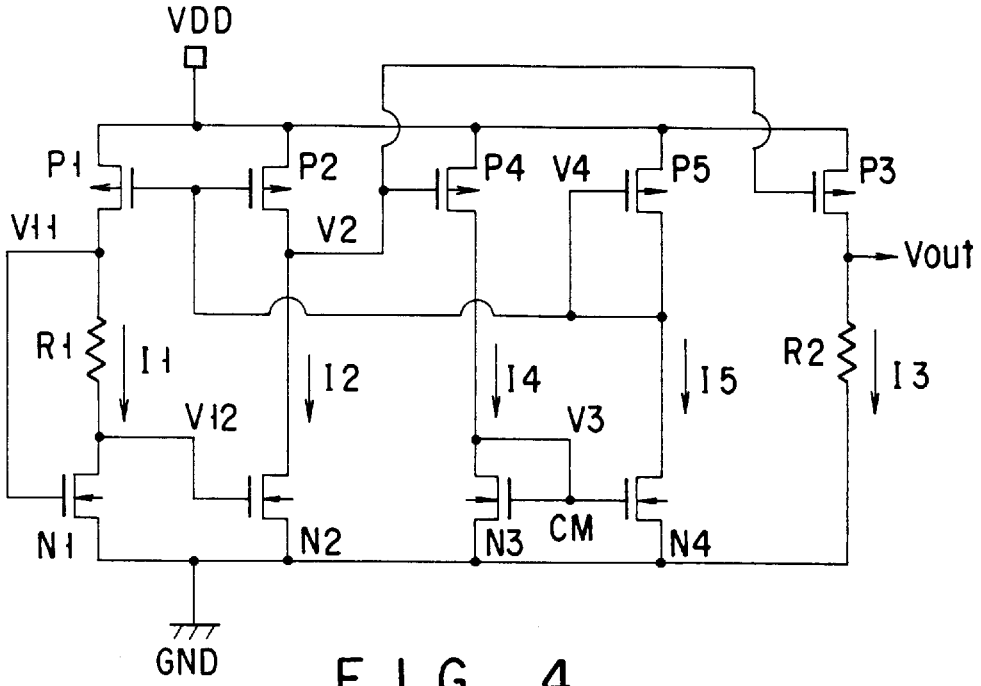
FIG. 4 is a circuit diagram showing a configuration of a constant voltage circuit according to a first embodiment of the present invention.

FIG. 4 shows a configuration of a first embodiment of a constant voltage circuit or regulator according to the present invention. The parts corresponding to those of the conventional circuit of FIG. 1 denote the same or equivalent reference numerals or symbols, and the descriptions thereof will be explained.

A source of a P-channel MOS transistor P1 is connected to a positive polarity power source voltage VDD (first power source). One end of a resistor R1 is connected to a drain of the MOS transistor P1. A source of a P-channel MOS transistor P2 is connected to the VDD. A gate of the MOS transistor P2 is connected to a gate of the MOS transistor P1. A drain of an N-channel MOS transistor N1 is connected to the other end of the resistor R1. A source of the MOS transistor N1 is connected to a ground voltage GND (second power source), and a gate of the MOS transistor N1 is connected to the one end of the resistor R1, namely, the drain side of the MOS transistor P1. A drain of an N-channel MOS transistor N2 is connected to the drain of the MOS transistor P2. A source of the MOS transistor N2 is connected to the ground voltage GND, and a gate of the MOS transistor N2 is connected to the other end of the resistor R1, namely the drain side of the MOS transistor N1.

A source of a P-channel MOS transistor P3 is connected to the VDD. A drain of the MOS transistor P3 is connected to an output terminal for obtaining an output voltage Vout, and a gate of the MOS transistor P3 is connected to the drain of the MOS transistor P2. A resistor R2 is connected between the output terminal and the ground voltage GND.

Further, a source of a P-channel MOS transistor P4 is connected to the VDD. A gate of the MOS transistor P4 is connected to the drain of the MOS transistor P2. A drain of an N-channel MOS transistor N3 is connected to the drain of the MOS transistor P4. A source of the MOS transistor N3 is connected to the ground voltage GND, and a gate and a drain of the MOS transistor N3 are connected. A source of a P-channel MOS transistor P5 is connected to the VDD. A gate of the MOS transistor P5 is connected to a gate common connecting point of the MOS transistors P1 and P2, and further the gate and the drain are connected. A drain of an N-channel MOS transistor N4 is connected to the drain of the MOS transistor P5. A source of the MOS transistor N4 is connected to the ground voltage GND, and a gate of the MOS transistor N4 is connected to the gate of the MOS transistor N3. That is, the N-channel MOS transistors N3 and N4 constitute a current mirror circuit CM, which is so operated that a current I5 of the value proportional to a current I4 flowing to the MOS transistor P4 flows to the MOS transistor P5.

Figure 1:
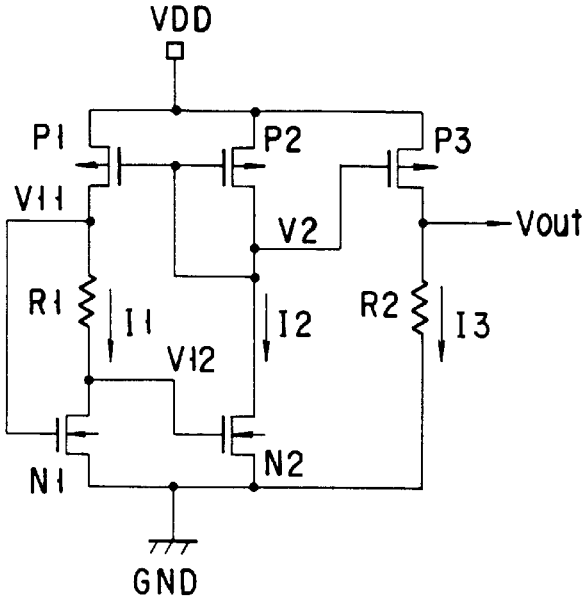
FIG. 1 PRIOR ART
FIG. 1 is a circuit diagram showing an example of a conventional constant voltage circuit.
Figure 2:
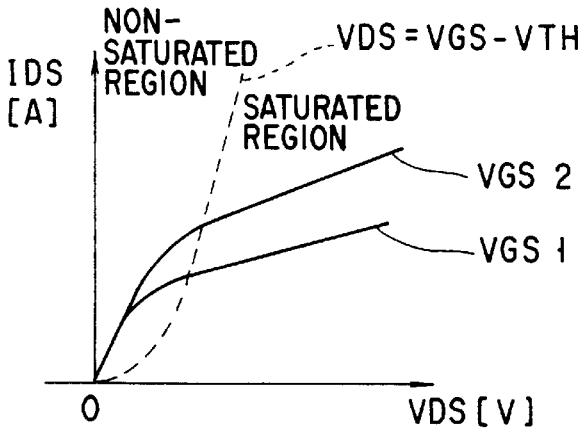
FIG. 2 PRIOR ART
FIG. 2 is a characteristic diagram for explaining the operation of the conventional circuit of FIG. 1.
Figure 3:
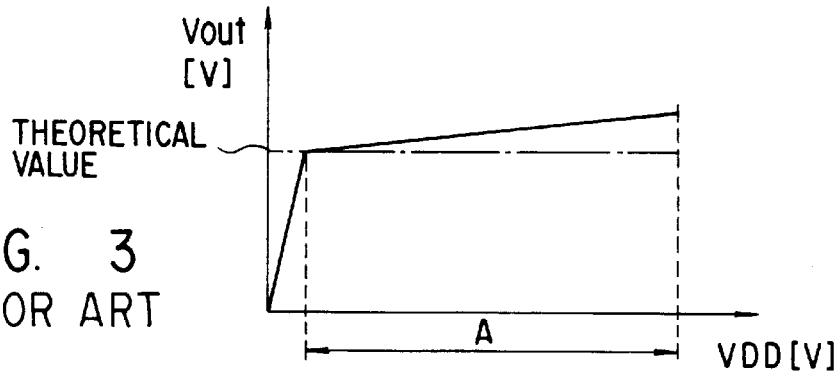
FIG. 3 PRIOR ART
FIG. 3 is a characteristic diagram of the conventional circuit of FIG. 1.

More specifically, according to the constant voltage circuit of this embodiment, current mirror circuits CM made of the P-channel MOS transistors P4, P5 and two N-channel MOS transistors N3, N4 are added to the conventional circuit shown in FIG. 1, a constant current I4 is generated by the MOS transistor P4 in which the voltage V2 is inputted to its gate, the current I4 is reflected to the MOS transistor P5 through the current mirror circuit, and the current of the value proportional to the current I4 is reflected to the MOS transistors P1, P2 for constituting the current mirror circuit together with the MOS transistor P5.

Then, the operation of the constant voltage circuit of FIG. 4 when the power source voltage VDD is changed will be described.

When the power source voltage VDD is changed so that its value is increased, the value of the current I1 flowing to the MOS transistor P1 and the resistor R1 is increased. As the current I1 increases, the voltage drop across the resistor R1 is increased, and the gate voltage v12 of the MOS transistor N2 is lowered. Thus, the conducting resistance of the MOS transistor N2 is increased, and the value of the current I2 flowing to the MOS transistor N2 and the MOS transistor P2 is decreased. As the current I2 decreases, the gate voltage V2 of the MOS transistor P4 is raised. Thus, the conducting resistance of the MOS transistor P4 is increased, and the value of the current I4 flowing to the MOS transistor P4 and the MOS transistor N3 is lowered. Further, the value of the current I5 flowing to the MOS transistor N4 and the MOS transistor P5 is lowered. Since the MOS transistor P1 constitutes a current mirror circuit together with the MOS transistor P5, when the current I5 decreases, the current I1 is also reduced. That is, even if the current I1 is increased as the power source voltage VDD is increased, a feedback is applied by the circuit having the MOS transistors P4, P5 and the current mirror circuit CM to suppress the increase of the current I1. Thus, it is so controlled that the current I3 flowing to the MOS transistor P3 and the resistor R2 becomes constant irrespective of the change in the power source voltage VDD. As a result, the output voltage Vout of a predetermined value is always obtained.

Contrary to the above case, even if the power source voltage VDD is lowered so that the current II decreases, it can be similarly inferred to the above-described case, and hence the operation thereof will be omitted.

Then, the operation of the case that the influence of the channel length modulation effect is considered will be described. In the conventional circuit of FIG. 1, since the current ratio defined by the WP1/WP2, WN2/WN1 in the formula (6) by the channel length modulation effect and the WP3/WP2 used to induce the equation (7) by the channel length modulation effect is apparently equivalent to the change of the power source voltage, the parameter of the power source voltage internally exists in the WP1/WP2, WN2/WN1, WP3/WP2. That is, the output voltage Vout is changed.

On the contrary, in the circuit of FIG. 4, the V12 is forcibly lowered to the GND side as the I1 increases, and hence the IDS of the MOS transistor N2 is decreased. Since the value of the voltage V2 of the voltage of the drain common connecting point of the MOS transistors N2 and P2 is determined according to the value of the IDS of the MOS transistors N2 and P2, when the IDS of the MOS transistor N2 is lowered, the voltage V2 moves in the direction of for raising the voltage V2 to the VDD side. Thus, the gate bias of the MOS transistor P4 is lowered, and the force for lowering the IDS of the MOS transistor P4 is acted. However, since the voltage V3 of the gate common connecting point of the MOS transistors N3 and N4 becomes the value near the threshold value voltage VTHN of the MOS transistor N3, as the VDD increases, the VDS of the MOS transistor P4 is raised to suppress the reduction of the I4.

The current I5 proportional to the I4 is output from the current mirror circuit CM. Further, the gate biases of the MOS transistors P1, P2 are determined according to the MOS transistor P5, but since the voltage V4 of the gate common connecting point of the MOS transistors P1, P2 and P5 is set to the value near (VDD−|VTHP5|) (where the VTHP5 is the threshold voltage of the P-channel MOS transistor P5) and the V11 is set to the value near (I1·R1+VTHN1) (where the VTHN1 is the threshold voltage of the N-channel MOS transistor N1), as the VDD increases, the VDS of the MOS transistors N4, P1 are raised. Accordingly, the current I5 is raised, the voltage V4 is forcibly lowered to the GND side, and the IDS of the MOS transistors P1, P2 moves in the direction of increase by the increase of the VDD. That is, as the VDD is raised, the IDS of the MOS transistor P2 is raised and the IDS of the MOS transistor N2 is lowered to be complimentarily operated, and hence further change can be obtained as the voltage V2, the gate bias of the MOS transistor P3 is forcibly lowered, and the increase of the IDS due to the channel length modulation effect of the P-channel MOS transistor P3 can be canceled.

Since the voltage V2 is used as the common gate bias at the P-channel MOS transistors P3, P4, the forcible lowering of the IDS equivalent to the occurrence at the MOS transistor P3 is generated in the MOS transistor P4, and hence the fact that the IDS of the MOS transistor P3 is excessively lowered does not occur.

Figure 5:
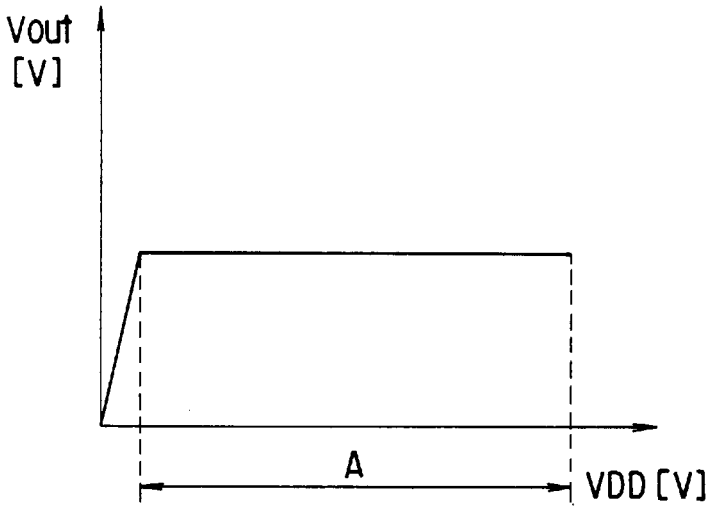
FIG. 5 is a characteristic diagram of the constant voltage circuit of FIG. 4.

In the constant voltage circuit according to this first embodiment as described above, the influence of the channel length modulation effect of the MOS transistor can be removed, and as shown in FIG. 5, the value of the output voltage Vout does not depend upon the power source voltage in the operating region A of the constant voltage circuit, but always exhibits predetermined characteristics that it coincides with the theoretical value.

Since the circuit section for determining the output voltage, the temperature characteristics and the minimum operating voltage, namely, the circuit section having the P-channel MOS transistors P1, P2, P3, the N-channel MOS transistors N1, N2 and the resistors R1, R2 is constituted substantially by the same as the conventional circuit, only the power source voltage dependence can be improved without affecting the influence to other circuit characteristics.

Furthermore, since it is not necessary to increase the channel length of the MOS transistor as the prior art, though the number of the MOS transistors is increased by four as compared with the conventional circuit, the sizes of the individual transistors can be decreased as compared with the case of the conventional circuit that the remedy of the power source voltage dependence is executed, and hence the occupying area on a semiconductor chip can be reduced as compared with the prior art.

Then, other embodiments of the constant voltage circuit according to the present invention will be described.

Figure 6:
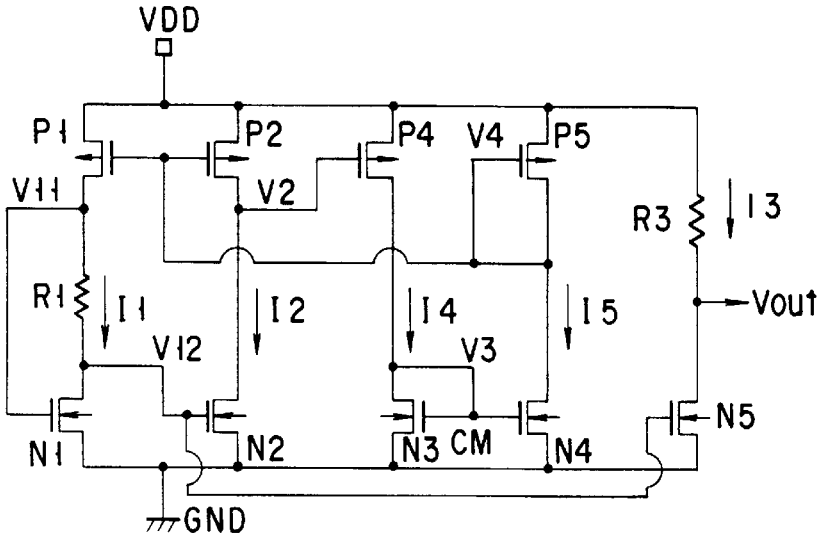
FIG. 6 is a circuit diagram showing a configuration of a constant voltage circuit according to a second embodiment of the present invention.

FIG. 6 shows a configuration of a constant voltage circuit according to a second embodiment of the present invention. In the constant voltage circuit of the first embodiment shown in FIG. 4, the case that a current path between the source and the drain of the P-channel MOS transistor P3 and the resistor R2 are connected between the VDD and the GND and the output voltage Vout is obtained from the connecting point has been described. However, in this second embodiment, it is modified so that a resistor R3 is connected between the VDD and the Vout instead of the P-channel MOS transistor P3 and the resistor R2, a current path between the drain and the source of the N-channel MOS transistor N5 is connected between the output terminal of the Vout and the GND and the voltage V12 of the other end of the resistor R1 is supplied to the gate of the N-channel MOS transistor N5 to obtain the output voltage Vout. In this case, the value with the VDD as a reference is obtained as the output voltage Vout.

Figure 7:
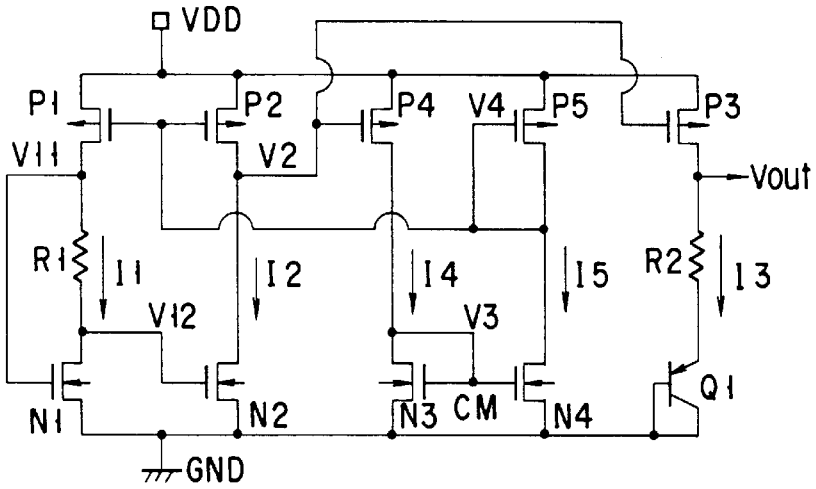
FIG. 7 is a circuit diagram showing a configuration of a constant voltage circuit according to a third embodiment of the present invention.

FIG. 7 shows a configuration of a constant voltage circuit according to a third embodiment of the present invention. In the constant voltage circuit of this third embodiment, an emitter and a base of a PNP bipolar transistor Q1 operating as a diode element is inserted between the resistor R2 and the GND in the circuit of FIG. 4. In FIG. 7, it is noted that, though the emitter and the bias of only one bipolar transistor Q1 is inserted between the resistor R2 and the GND, the emitters and the bases of two or more bipolar transistors may be inserted in series as required or collectors of the respective bipolar transistors are connected to the respective bases.

According to the constant voltage circuit of such a configuration described above, a forward current flows between the emitter and the base of the bipolar transistor Q1, and hence the value of the output voltage Vout becomes the value shifted by the forward voltage drop of the diode element to the VDD side as compared with the case of FIG. 4. Further, the value of the voltage drop I3·R2 generated at the resistor R2 has positive temperature dependency at the K of the equation (6), it has positive temperature coefficient. On the contrary, the forward voltage drop of the diode element has a negative temperature coefficient. Thus, the temperature dependency of the output voltage Vout can be substantially eliminated by suitably setting the value of the resistor R2 and suitably selecting the number of the diode elements.

Figure 8:
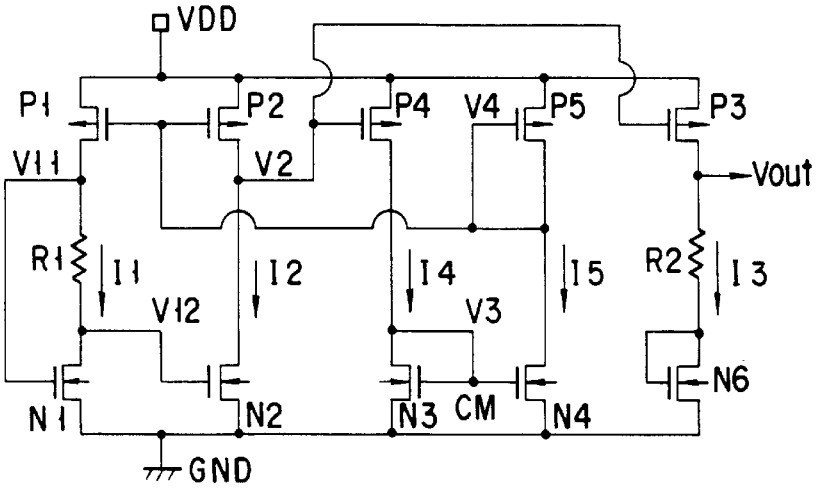
FIG. 8 is a circuit diagram showing a configuration of a constant voltage circuit according to a fourth embodiment of the present invention.

FIG. 8 shows a configuration of a constant voltage circuit according to a fourth embodiment of the present invention. In the constant voltage circuit of this fourth embodiment, an N-channel MOS transistor is used as the previous diode element. Even in this case, in FIG. 8, a current path between the source and the drain of one MOS transistor N6 is connected in series with the resistor R2. However, a current path between the sources and the drains of two or more MOS transistors may be inserted in series as required. Further, the gates of the respective MOS transistors are connected to the respective drain sides.

Figure 9:
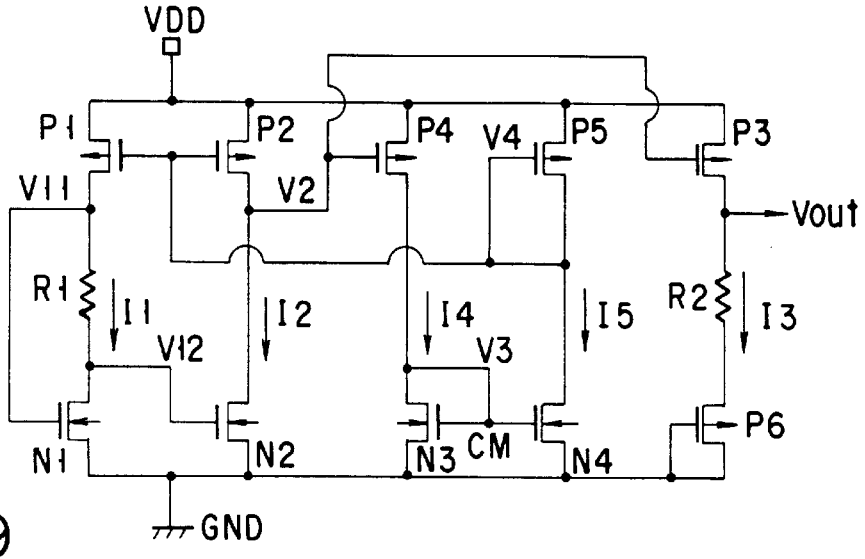
FIG. 9 is a circuit diagram showing a configuration a configuration of a constant voltage circuit according to a fifth embodiment of the present invention.

FIG. 9 shows a configuration of a constant voltage circuit according to a fifth embodiment of the present invention. In the constant voltage circuit of this fifth embodiment, a P-channel MOS transistors P6 is used as the previous diode element. Even in this case, in FIG. 9, a current path between the source and the drain of the one MOS transistor P6 is connected in series with the resistor R2. However, current path between the sources and the drains of two or more MOS transistors may be inserted in series as required. The gates of these MOS transistors are connected to the respective drain side.

Figure 10:
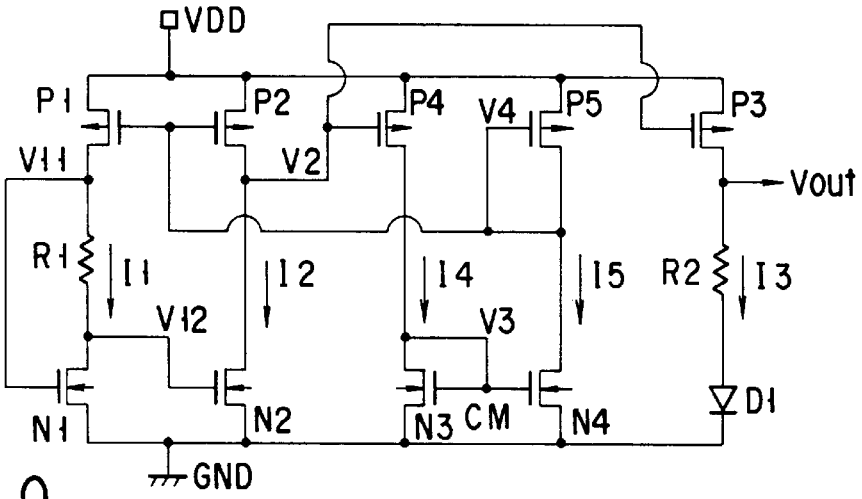
FIG. 10 is a circuit diagram showing a configuration of a constant voltage circuit according to a sixth embodiment of the present invention.

FIG. 10 shows a configuration of a constant voltage circuit according to a sixth embodiment of the present invention. In the constant voltage circuit of this sixth embodiment, a PN diode is used as the previous diode element. Even in this case, in FIG. 10, the anode and the cathode of one PN junction diode D1 is connected in series with the resistor R1. However, two or more PN junction diodes may be inserted in series as required.

Figure 11:
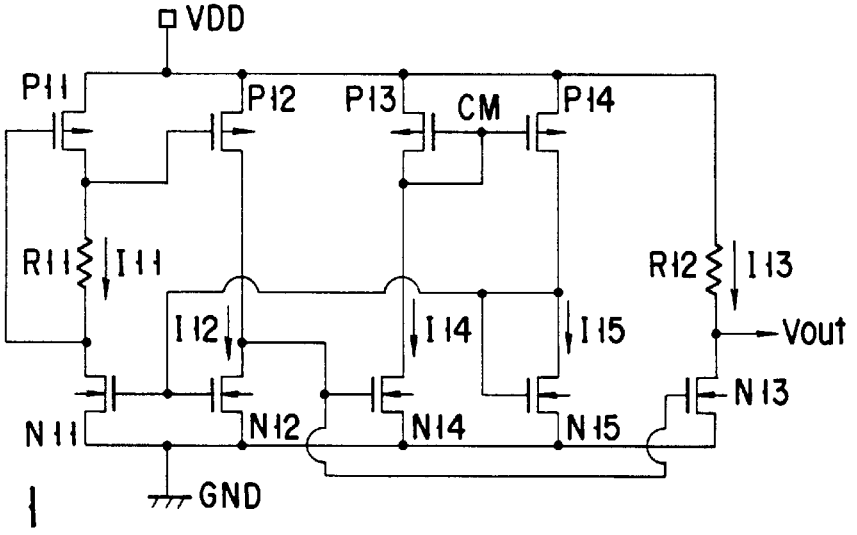
FIG. 11 is a circuit diagram showing a configuration of a constant voltage circuit according to a seventh embodiment of the present invention.

FIG. 11 shows a configuration of a constant voltage circuit according to a seventh embodiment of the present invention. In the constant voltage circuit of this seventh embodiment, the connection of the power source voltage VDD and the GND in the constant voltage circuit of the first embodiment shown in FIG. 4 is reversely conducted, and P-channel MOS transistors P11, P12, P13, P14 and N-channel MOS transistors N11, N12, N13, N14, N15 having opposite polarities are used instead of the P-channel MOS transistors P1, P2, P3, P4, P5 and N-channel MOS transistors N1, N2, N3, N4. Incidentally, N-channel MOS transistors N11, N12, N13, N14, N15 respectively correspond to the previous P-channel MOS transistors P1, P2, P3, P4, P5, and P-channel MOS transistors P11, P12, P13, P14 respectively correspond to the previous N-channel MOS transistors N1, N2, N3, N4, and resistors R11, R12 respectively correspond to the previous resistors R1, R2.

Even in the constant voltage circuit of such a configuration, the similar effect to that of the constant voltage circuit of the first embodiment shown in FIG. 4 can be obtained.

Figure 12:
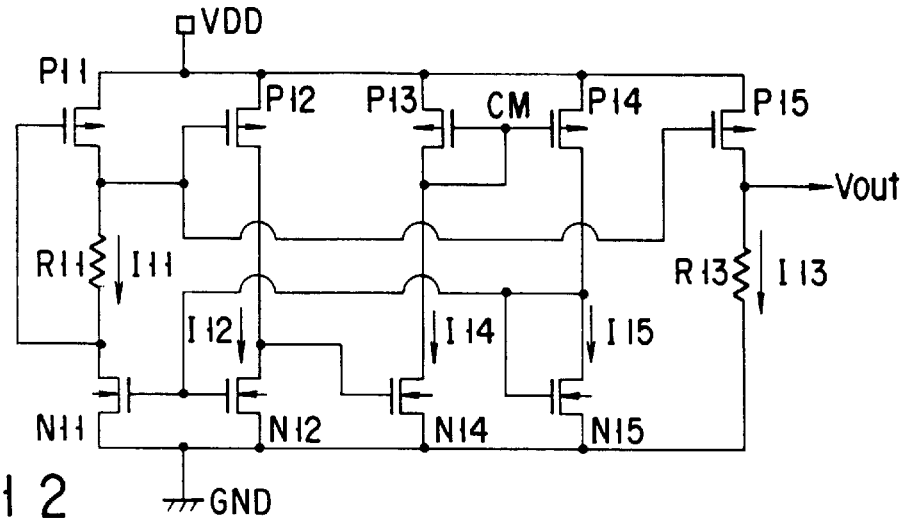
FIG. 12 is a circuit diagram showing a configuration of a constant voltage circuit according to a eighth embodiment of the present invention.

FIG. 12 shows a configuration of a constant voltage circuit according to an eighth embodiment of the present invention. In the constant voltage circuit of this eighth embodiment, the similar modification to that of the case of the second embodiment of FIG. 6 is added to the constant voltage circuit of the seventh embodiment of FIG. 11.

More specifically, a circuit connection is modified so that a resistor R13 is connected between the GND and the output terminal of the Vout instead of providing the N-channel MOS transistor N13 and the resistor R12 in the constant voltage circuit of FIG. 11, further a current path between the source and the drain of a P-channel MOS transistor P15 is connected between the VDD and the output terminal of the Vout and the voltage of the other end (the drain side of the MOS transistor P11) of the resistor R11 corresponding to the resistor R1 is supplied to the gate of the MOS transistor P15.

Figure 13:
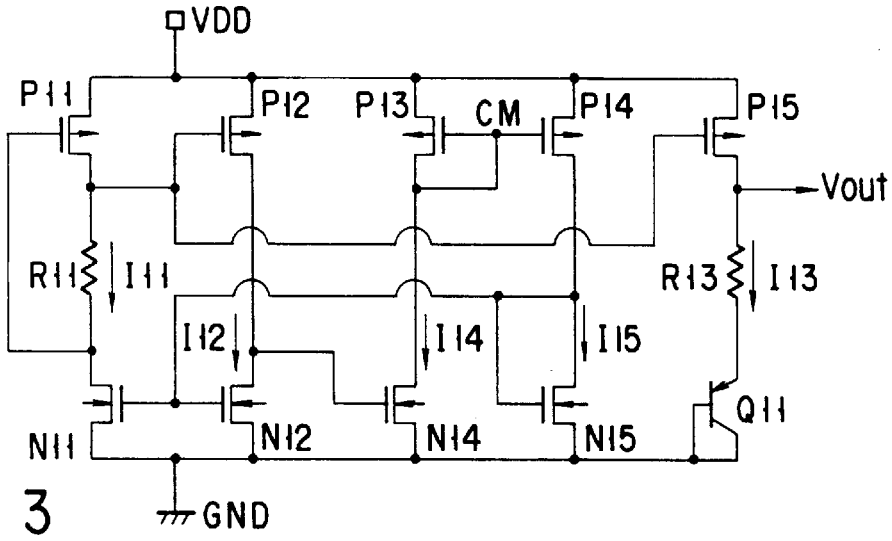
FIG. 13 is a circuit diagram showing a configuration of a constant voltage circuit according to a ninth embodiment of the present invention.

FIG. 13 shows a configuration of a constant voltage circuit according to a ninth embodiment of the present invention. In the constant voltage circuit of this ninth embodiment, the emitter and the base of the PNP bipolar transistor Q11 operating as a diode element is inserted between the resistor R13 and the GND in FIG. 12 similarly to the case of the third embodiment shown in FIG. 7. Incidentally, in FIG. 13, the emitter and the base of the one bipolar transistor Q11 is inserted, but the emitters and the bases of two or more bipolar transistors may be inserted as required. The collectors of the respective bipolar transistors are connected to the respective bases.

Even in the constant voltage circuit of these embodiments, the temperature dependency of the output voltage Vout can be substantially eliminated due to the similar reasons as described previously.

Figure 14:
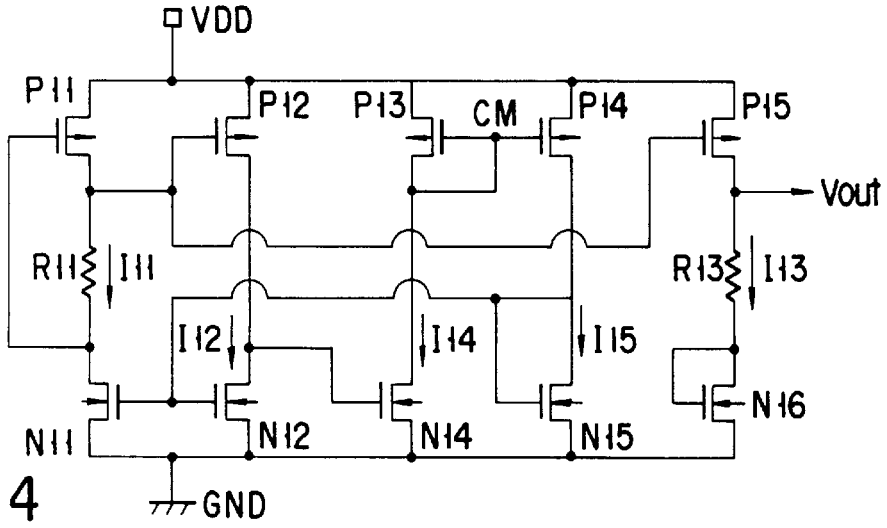
FIG. 14 is a circuit diagram showing a configuration of a constant voltage circuit according to a tenth embodiment of the present invention.

FIG. 14 shows a configuration of a constant voltage circuit according to a tenth embodiment of the present invention. In the constant voltage circuit of this tenth embodiment, an N-channel MOS transistor N16 is used as the previous diode element. Even in this case, a current path between the source and the drain of one MOS transistor N16 is connected in series with the resistor R13, but a current path between the sources and the drains of two more MOS transistors may be inserted in series as required. Further, the gates of the respective MOS transistors are connected to the drain sides.

Figure 15:
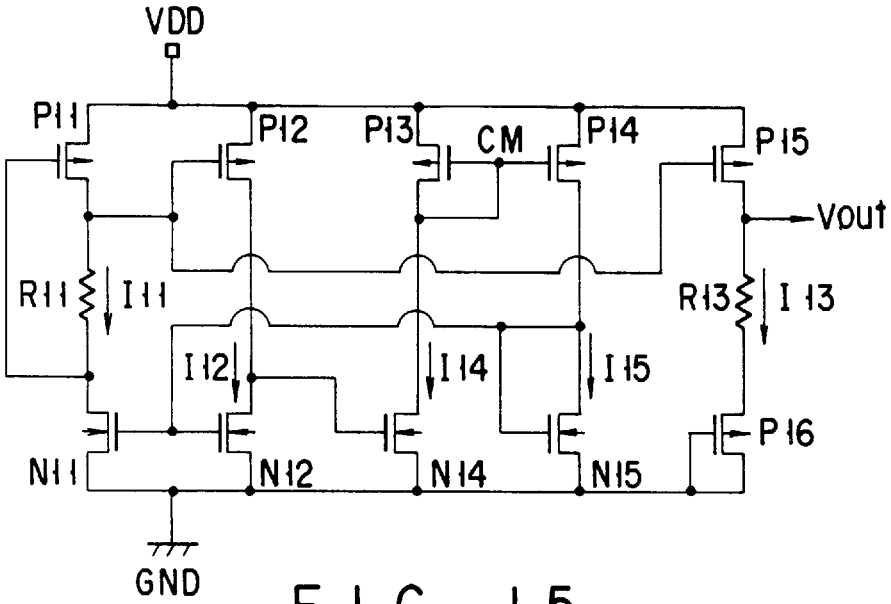
FIG. 15 is a circuit diagram showing a configuration of a constant voltage circuit according to a eleventh embodiment of the present invention.

FIG. 15 shows a configuration of a constant voltage circuit according to an eleventh embodiment of the present invention. In the constant voltage circuit of this eleventh embodiment, a P-channel MOS transistor P16 is used as the previous diode element. Even in this case, a current path between the source and the drain of only one MOS transistor P16 is connected in series with the resistor R13 in FIG. 15. However, a current path between the sources and the drains of two or more MOS transistors may be inserted in series as required. The gates of the MOS transistors are connected to the respective drain sides.

Figure 16:
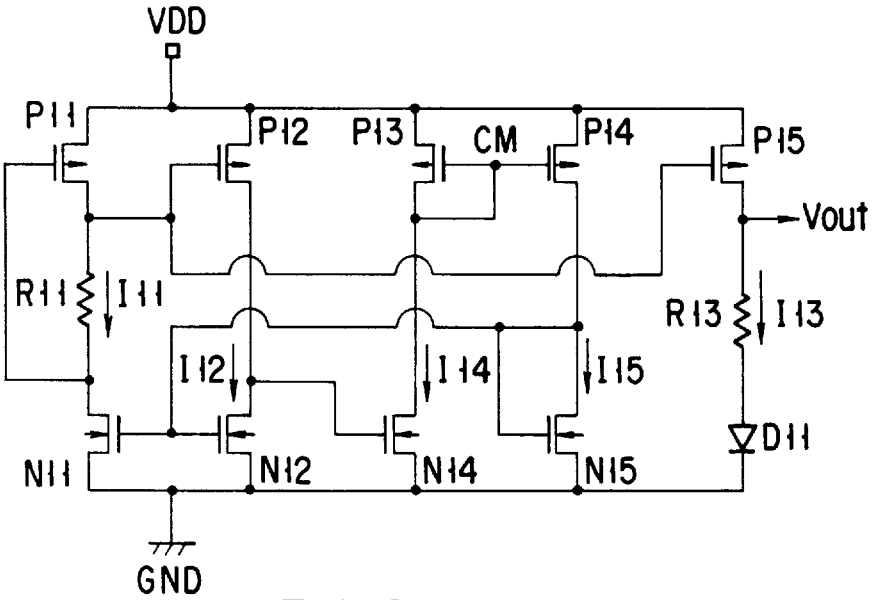
FIG. 16 is a circuit diagram showing a configuration of a constant voltage circuit according to a twelfth embodiment of the present invention.

FIG. 16 shows a configuration of a constant voltage circuit according to a twelfth embodiment of the present invention. In the constant voltage circuit of this twelfth embodiment, a PN junction diode is used as the previous diode element. Even in this case, the anode and the cathode of the one PN junction diode D11 is connected in series with the resistor R13. However, two or more PN junction diodes may be inserted in series as required.

It is noted that the PNP bipolar transistors, N-channel MOS transistors, P-channel MOS transistors and PN junction diode operating as the diode element in the constant voltage circuit of the respective embodiments shown in FIGS. 13 to 16 may be inserted between the resistor R12 and the power source VDD in the constant voltage circuit of the embodiment of FIG. 11. In this case, the diode element to be inserted is not limited to the one but a plurality of the diode elements to be inserted may be inserted in series.

According to the present invention described above, the accurate constant voltage circuit which does not depend upon the power source voltage can be realized. Since the configuration of the circuit section for determining the output voltage, the temperature characteristics and the minimum operating voltage is substantially the same as that of the conventional circuit, only the power source voltage dependence can be improved without influence to the circuit characteristics. Furthermore, the channel length of the MOS transistor can be reduced, and since the number of the elements to be added is little, the occupying area on the semiconductor chip can be reduced as compared with the conventional circuit.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A constant voltage circuit comprising:

first and second power sources;

a first polarity first MOS transistor connected at one end of a current path to said first power source;

a first polarity second MOS transistor connected at one end of a current path to said first power source and connected at a gate thereof to a gate of said first MOS transistor;

a first resistor connected at one end thereof to the other end of the current path of said first MOS transistor;

a second polarity third MOS transistor connected at one end of a current path to the other end of said first resistor, connected at the other end of the current path to said second power source and connected at a gate thereof to the one end of said first resistor;

a second polarity fourth MOS transistor connected at one end of a current path to the other end of the current path of said second MOS transistor, connected at the other end of the current path to said second power source and connected at a gate thereof to the other end of said first resistor;

a first polarity fifth MOS transistor connected at one end of a current path to said first power source and connected at a gate thereof to the other end of the current path of said second MOS transistor;

a first polarity sixth MOS transistor connected at one end of a current path to said first power source, connected at a gate thereof to a gate common connecting point of said first and second MOS transistors and connected at the gate thereof to the other end of the current path;

a current mirror circuit for supplying a current proportional to a current flowing to the current path of said fifth MOS transistor to said sixth MOS transistor;

a first polarity seventh MOS transistor connected at one end of a current path to said first power source, connected at the other end of the current path to a constant voltage output terminal and connected at a gate thereof to the other end of the current path of said second MOS transistor; and a second resistor inserted between said constant voltage output terminal and said second power source.

2. A constant voltage circuit comprising:

first and second power sources;

a first polarity first MOS transistor connected at one end of a current path to said first power source;

a first polarity second MOS transistor connected at one end of a current path to said first power source and connected at a gate thereof to a gate of said first MOS transistor;

a first resistor connected at one end thereof to the other end of the current path of said first MOS transistor;

a second polarity third MOS transistor connected at one end of a current path to the other end of said first resistor, connected at the other end of the current path to said second power source and connected at a gate thereof to the one end of said first resistor;

a second polarity fourth MOS transistor connected at one end of a current path to the other end of the current path of said second MOS transistor, connected at the other end of the current path to said second power source and connected at a gate thereof to the other end of said first resistor;

a first polarity fifth MOS transistor connected at one end of a current path to said first power source and connected at a gate thereof to the other end of the current path of said second MOS transistor;

a first polarity sixth MOS transistor connected at one end of a current path to said first power source, connected at a gate thereof to a gate common connecting point of said first and second MOS transistors and connected at the gate thereof to the other end of the current path;

a current mirror circuit for supplying a current proportional to a current flowing to the current path of said fifth MOS transistor to said sixth MOS transistor;

a second resistor inserted between said first power source and a constant voltage output terminal; and a second polarity seventh MOS transistor connected at one end of a current path to the constant voltage output terminal, connected at the other end of the current path to said second power source and connected at a gate thereof to the other end of said first resistor.

3. A constant voltage circuit according to claim 1 or 2, wherein said current mirror current comprises:

a second polarity eighth MOS transistor connected at one end of a current path to the other end of the current path of said fifth MOS transistor, connected at the other end of the current path to said second power source and connected at a gate thereof connected to one end of the current path; and a second polarity ninth MOS transistor connected at one end of a current path to the other end of the current path of said sixth MOS transistor, connected at the other end of the current path to said second power source and connected at a gate thereof to the gate of said eighth MOS transistors.

4. A constant voltage circuit according to claim 1, further comprising:

one or a plurality of diode elements inserted between said constant voltage output terminal and said second power source in a direction that a current flows in series with said second resistor.

5. A constant voltage circuit according to claim 2, further comprising:

one or a plurality of diode elements inserted between said constant voltage output terminal and said first power source in a direction that a current flows in series with said second resistor.

6. A constant voltage circuit according to claim 4 or 5, wherein said diode element is constituted by a bipolar transistor which base is connected with a collector thereof.

7. A constant voltage circuit according to claim 4 or 5, wherein said diode element is constituted by an N-channel MOS transistor which gate is connected with a drain thereof.

8. A constant voltage circuit according to claim 4 or 5, wherein said diode element is constituted by a P-channel MOS transistor which gate is connected with a drain thereof.

9. A constant voltage circuit according to claim 4 or 5, wherein said diode element is constituted by a PN junction diode.

* * * * *